US009353753B2

(12) United States Patent
Wilson et al.

(10) Patent No.: US 9,353,753 B2
(45) Date of Patent: May 31, 2016

(54) HELICAL DRIVER TO REDUCE STRESS IN BRITTLE BEARING MATERIALS

(75) Inventors: Brown Lyle Wilson, Tulsa, OK (US); Donn J. Brown, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 1031 days.

(21) Appl. No.: 13/173,282

(22) Filed: Jun. 30, 2011

(65) Prior Publication Data

US 2013/0004346 A1 Jan. 3, 2013

(51) Int. Cl.
*F04D 13/10* (2006.01)
*F04D 13/02* (2006.01)
*F04D 29/044* (2006.01)

(52) U.S. Cl.
CPC ..... *F04D 13/10* (2013.01); *F04D 13/022* (2013.01); *F04D 29/044* (2013.01)

(58) Field of Classification Search
CPC ..... F04D 3/00; F04D 13/021; F04D 13/06; F04D 13/08; F04D 13/086; F04D 13/10; F04D 19/02; F04D 25/06; F04D 25/0686; F04D 29/04; F04D 29/0405; F04D 29/042; F04D 29/043; F04D 29/044; F04D 29/05; F04D 29/053; F04D 29/054; F04D 29/086; F04D 29/10; F04D 29/106; F04D 29/20; F04D 29/2222; F04D 29/185; F04D 29/263; F04D 29/266; F04D 29/286; F04D 29/605; F04D 29/626; F04D 29/646; F04D 13/022
USPC ..... 417/360, 423.7, 423.11, 214, 424.1; 416/198 R, 212 R, 204 R, 244 R; 415/199.1–199.3
See application file for complete search history.

(56) References Cited

U.S. PATENT DOCUMENTS

| | | | | | |
|---|---|---|---|---|---|
| 1,739,756 | A * | 12/1929 | Granville | 464/149 |
| 3,542,178 | A * | 11/1970 | Ripple | 192/69.9 |
| 4,312,193 | A * | 1/1982 | Gibbs et al. | 464/88 |
| 4,454,922 | A * | 6/1984 | Jamison et al. | 175/323 |
| 4,655,655 | A * | 4/1987 | Schurfeld | 409/232 |
| 5,137,087 | A * | 8/1992 | Szarka et al. | 166/289 |
| 5,275,238 | A * | 1/1994 | Cameron | 166/105 |
| 6,370,979 | B1 * | 4/2002 | Tauschek et al. | 74/462 |
| 7,182,584 | B2 * | 2/2007 | Du et al. | 417/414 |
| 7,492,069 | B2 | 2/2009 | Knox | |
| 7,575,413 | B2 * | 8/2009 | Semple et al. | 415/107 |
| 2002/0050361 | A1 * | 5/2002 | Shaw et al. | 166/380 |
| 2006/0278387 | A1 * | 12/2006 | Parker | 166/77.2 |
| 2008/0101924 | A1 * | 5/2008 | Orban et al. | 415/199.2 |
| 2010/0166578 | A1 * | 7/2010 | Watson | 417/423.3 |
| 2013/0017075 | A1 * | 1/2013 | Orban et al. | 415/199.2 |

* cited by examiner

*Primary Examiner* — Justin Jonaitis
*Assistant Examiner* — Charles Nichols
(74) *Attorney, Agent, or Firm* — Bracewell LLP

(57) ABSTRACT

An electrical submersible pump (ESP) having a sleeve coupled to the shaft that rotates as the shaft rotates. The sleeve can be a base portion of a pump impeller, a journal bearing, or a bushing. A drive collar mounts around the shaft and has an end with a portion that projects past an end of the sleeve profiled to correspond with the shape of the projecting portion. As the shaft rotates the drive collar the projecting portion of the drive collar pushes against the profiled end of the sleeve to rotate the sleeve. The projecting portion can be a wedge shaped tab on the drive collar, or an angular segment of the drive collar extending axially past the remaining segments. The profiled end of the sleeve can include a recess formed to receive the tab and can have an angular segment corresponding to that on the drive collar.

8 Claims, 5 Drawing Sheets

HELICAL DRIVER TO REDUCE STRESS IN BRITTLE BEARING MATERIALS

BACKGROUND

1. Field of Invention

The present disclosure relates to downhole electric submersible pump (ESP) systems that are submersible in wellbore fluids. More specifically, the present disclosure involves a device and method for coupling a sleeve to a shaft so that the shaft transmits a rotational force to the sleeve without imparting angular deflections in the shaft to the sleeve.

2. Description of Prior Art

Submersible pumping systems are often used in hydrocarbon producing wells for pumping fluids from within the wellbore to the surface. These fluids are generally liquids and include produced liquid hydrocarbon as well as water. One type of system used employs an electrical submersible pump (ESP). ESPs are typically disposed at the end of a length of production tubing and have an electrically powered motor. Often, electrical power may be supplied to the pump motor via a cable. The pumping unit is usually disposed within the well bore just above where perforations are made into a hydrocarbon producing zone. This placement thereby allows the produced fluids to flow past the outer surface of the pumping motor and provide a cooling effect.

With reference now to FIG. 1, shown in a partial sectional view is a cased wellbore 8 having an ESP system 10 disposed therein. The ESP system 10 is made up of a motor 12, a seal section 14, and a pump 16 and is disposed within the wellbore 8 on production tubing 18. Seal section reduces a pressure differential between wellbore fluid and lubricant in motor 12. Energizing the motor 12 drives a shaft coupled between the motor 12 and the pump section 16. The source of the fluid drawn into the pump comprises perforations 20 formed through the casing of the wellbore 10; the fluid is represented by arrows extending from the perforations 20 to the pump inlet. The perforations 20 extend into a surrounding hydrocarbon producing formation 22. Thus the fluid flows from the formation 22, past the motor 12 on its way to the inlets.

Traditionally, ESP systems 10 include bearing assemblies along the shafts in the motor section, seal section, and pump. Often, the bearings are plain sleeve bearings that provide radial support. One example of a bearing assembly provided in a motor section is provided in a cross sectional view in FIG. 2. Shown is a shaft 24 with an outer sleeve 26 that is circumscribed by a stator stack 28. The sleeve 26 couples to the shaft 24, such as by a key 27, and rotates along with the shaft 24. A housing 30 encases the outer circumference of the stator stack 28. A bearing assembly 32 is set between the outer sleeve 26 and stator stack 28 that radially encompasses a portion of the sleeve 26. The motor bearing assembly 32 may have an insert 34 mounted on the outer circumference of the sleeve 26; a bearing carrier 36 encircles the insert 34 and in the absence of an insert directly mounts on the shaft sleeve. A T-ring 38 may be included that mounts to the inner surface of the stator stack 28 for preventing bearing rotation. The sleeve 26, and therefore the shaft 24, is radially supported by the insert 34 or the bearing carrier 36. A lubricant film (not shown) allows for sleeve 26 rotation within the insert 34 or the bearing carrier 36.

Referring to FIG. 3, shown in a side sectional view is a prior art example of bearings in a pump section of an ESP system. Diffusers 40 are typically coaxially stacked in close contact within a housing 30. An impeller 42 is stacked between each successive diffuser 40, where each impeller 42 is coupled to and rotates with the shaft 24. Passages 44 curve radially and lengthwise throughout the diffusers 40 that register with passages 46 that similarly curve radially and lengthwise through the impellers 42. Rotating the shaft 24, and thus the impellers 42, forces fluid through the passages 44, 46 to pressurize the fluid as it passes along the stack of diffusers 40 and impellers 42. A sleeve bearing 48 couples around and rotates with the shaft 24 to provide a bearing surface between the shaft 24 and inner circumference of the diffusers 40. As the shaft 24 rotates, a film of lubricating fluid is maintained between the bearing 48 and diffuser 40. A key 27 is used for securing the impellers 42 to the shaft 24. The sleeve 26, impeller 42, and/or bushings (not shown) that mount to the shaft 24 are typically formed from a hard brittle material such as tungsten carbide or cermets. The shaft 24 is generally made from a more elastic material (i.e. steel) and during high torque conditions, such as pump start up, the shaft 24 can angularly deform along its axis (twist). If the shaft 24 deformation is adjacent where it couples to a sleeve 26 or impeller 42, the twist is transferred via the key 27 to the sleeve 26 or impeller 42 to concentrate stresses therein and create fractures.

SUMMARY OF INVENTION

The present disclosure describes example embodiments of an electrical submersible pump (ESP). In one embodiment the ESP includes a drive collar mounted to a shaft, where the drive collar engages a sleeve so that when the shaft rotates it rotates the drive collar that in turn rotates the sleeve. The drive collar rotates the sleeve without transmitting stress to the sleeve from torsion in the shaft. The sleeve has an end that engages an end of the drive collar. The engaging ends of the sleeve and drive collar are made such that either the sleeve or drive collar can slide with respect to one another, but an area of contact is maintained between the drive collar and the sleeve. Example embodiments exist where the sleeve can be a journal bearing, a base portion of an impeller, or a bushing. A wedge shaped protrusion is provided on the end of the drive collar for engaging the annular sleeve by axially inserting into a recess provided on the end of the sleeve; in this example contact between the protrusion and the recess define the interface. In an example embodiment, lateral edges of the protrusion and the recess are beveled to increase the area of contact between the drive collar and the sleeve. In an example embodiment, the interface is in a plane oblique to an axis of the shaft. In an example embodiment, at least a portion of the respective ends of the sleeve and the drive collar in engagement are beveled at an angle oblique to the axis. In an example embodiment, the material of the drive collar is more elastic than the material of the sleeve so that when the shaft experiences circumferential deflection, the sleeve is isolated from the deflection by the drive collar.

Also disclosed herein is an example of a submersible pump that includes a drive shaft driven by a motor, and an annular drive collar mounted on the shaft that rotates with the shaft and can slide along the shaft. The drive collar has an engaging end where at least a portion has a generally linear profile oriented oblique to an axis of the shaft. Also included on the shaft is an annular sleeve that also has an engaging end, a portion of which is configured with a generally linear profile that corresponds to the profile on the engaging end of the drive collar. When the engaging ends of the drive collar and sleeve are mated, the engaging ends are in contact along an interface that maintains a defined area with axial relative movement between the sleeve and the drive collar. In an example embodiment, the engaging end of the drive collar is a wedge shaped member axially protruding from a portion of a circumference of the engaging end of the drive collar. In an example embodiment, the engaging end of the sleeve is a wedge shaped recess configured to receive the member of the drive collar. In an example embodiment, the member has lateral edges that are beveled thereby increasing the area of the interface. In an example embodiment, the engaging end of the drive collar approximates a circle, and wherein the portion of the engaging end of the drive collar on a side of a line bisecting circle project past the portion of the engaging end of the drive collar on an opposing side of the line. In an example embodiment, the engaging end of the sleeve is profiled to correspond to the engaging end of the drive collar, so that the interface lies in a plane that is oblique to the axis. In an example embodiment, a terminal surface on the engaging end of the drive collar is profiled so that an angle between the collar terminal surface and axis varies along a circumference of the engaging end of the drive collar. In an example embodiment, a terminal surface on the engaging end of the sleeve is profiled so that an angle between the sleeve terminal surface and axis varies along a circumference of the engaging end of the sleeve. In an example embodiment, the drive collar is formed from a material that is more elastic than a material of the sleeve. In an example embodiment, a key slot extends from within the shaft and into the drive collar and a key in the key slot mounts the drive collar to the shaft.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 4A:
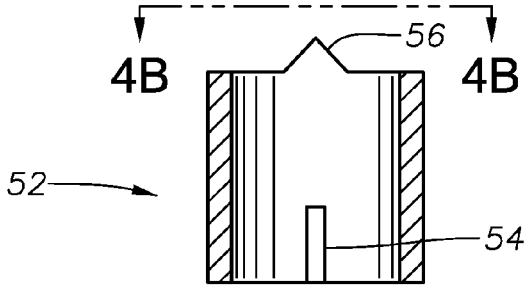
FIGS. 4A and 5A are side sectional views of respective embodiments of a driver bushing and a driven bushing in accordance with the present disclosure.
Figure 4B:
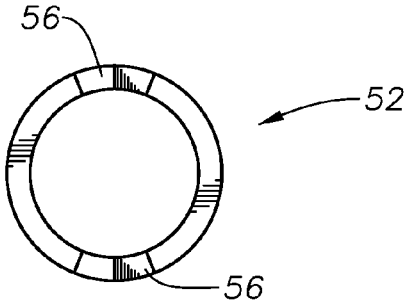
FIGS. 4B and 5B are end views respectively of the bushings of FIGS. 4A and 5A.

A side sectional view of an example embodiment of a driver collar 52 is provided in FIG. 4A. In this example, the collar 52 is shown as a generally annular member and having an optional keyway 54 formed axially along a portion of its inner surface. Registering the keyway 54 with a keyway on a shaft (not shown), the driver collar 52 can be rotated by rotation of the shaft while allowing the driver collar 52 to axially move along the shaft. The driver collar 52 is further shown having a wedge-shaped tooth 56 protruding from its upper end. The thickness of the tooth 56 is approximately the same as the thickness of the side wall of the driver collar 52. The width of the tooth 56 can vary depending on its application and embodiments exist wherein the width of the tooth 56 ranges from about 5% to about 20% of the circumference of the driver collar 52. FIG. 4B is an overhead view of the driver collar 52 showing a tooth 56 on opposing sides of the driver collar 52 and approximately 180 degrees from one another. Example embodiments exist wherein the driver collar 52 has a single tooth 56 or more than two.

Figure 5A:
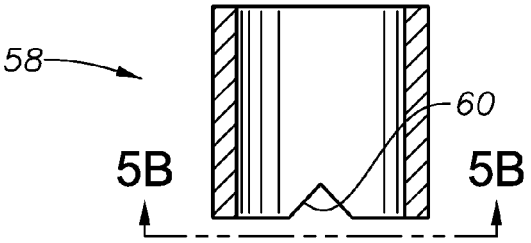
Figure 5B:
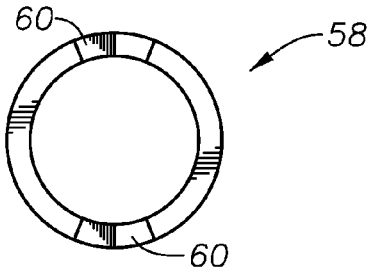

FIG. 5A illustrates a side sectional view of a sleeve 58, that as will be described in more detail below, is driven by the driver collar 52. More specifically, the sleeve 58 is a generally annular member and as shown has a recess 60 formed along the terminal end of the sleeve 58 that faces the driver collar 52. A plan view of the lower end of the sleeve 58 is shown in FIG. 5B wherein another recess 60 is shown on the lower end of the sleeve 58 at about 180 degrees apart from the first recess 60. As will be described in further detail below, the driver collar 52, which attaches to a shaft, is rotated with a shaft rotation that in turn rotates the sleeve 58 by contact between the tooth 56 and recess 60.

Example embodiments exist wherein the driver collar 52 is formed from a material that is more elastic than the material used for forming the sleeve 58. Example materials for the sleeve include tungsten carbide and/or cermet. Example materials for the driver collar 52 include carbide or iron alloys having nickel content ranging from 14 to 25% by weight.

Figure 6:
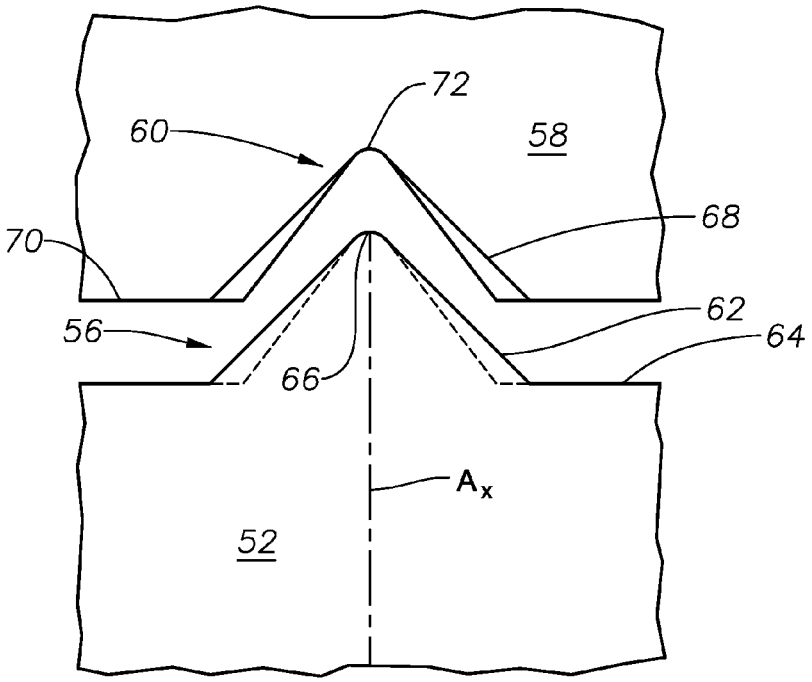
FIG. 6 is an enlarged side view of a portion of the bushings of FIGS. 4A and 5A.

An example embodiment of the tooth 56 and recess 60 of FIGS. 4A and 5A is shown in a side perspective view in FIG. 6. The tooth 56 is shown having lateral edges 62 that extend from an upper end 64 of the driver collar 52 up to a crest 66 that defines the upper terminal end of the tooth 56. The lateral edges 62, as illustrated by the dashed line, are beveled at angles that depend towards a mid-portion of the tooth 56. Similarly, the recess 60 has lateral edges 68 shown extending from a lower end of the sleeve 58 and joining at a base 72 defined at the upper end of the recess 60. The lateral edges 68 of the recess 60 are also beveled and depend in a direction towards the mid-portion of the recess 60 and so that the lateral edges 68 of the recess 60 correspond with the beveled lateral edges 62 of the tooth 56. An advantage of the beveling of the lateral edges 62, 68 on the driver collar 52 and sleeve 58 is to increase the area along which the tooth 56 and recess 60 contact (also referred to herein as an interface), thereby reducing localized concentrated stresses. Further, the profiles of the lateral edges 62, 68 are shown as being a generally linear path so that during use, one of the driver collar 52 or sleeve 58 may move in an axial direction with respect to the other while still maintaining an area of contact interface between the driver collar 52 and sleeve 58. That is, as shown in FIG. 6, beveling is apparent along lateral edge 68, whereas lateral edge 62 appears flat. It should be pointed out that the respective contours of the lateral edges 62, 68 are such that when and if the driver collar 52 and sleeve 58 axially reciprocate back and forth, the lateral edges 62, 68 continue to remain in contact along a defined area rather than a contact point. Some prior art designs, such as those having a wave-type profile, contact along a point when being axially reciprocated, which can produce highly concentrated stress loads that may lead to fracture of one or more of the components. In an example, compressive forces exist along a major portion of the driving or contact surface. Stress concentrations can develop in the corners and can be troublesome if left sharp; which can be alleviated with radiuses at these corners, whose surfaces may be described by rays perpendicular to the axis.

Figure 7A:
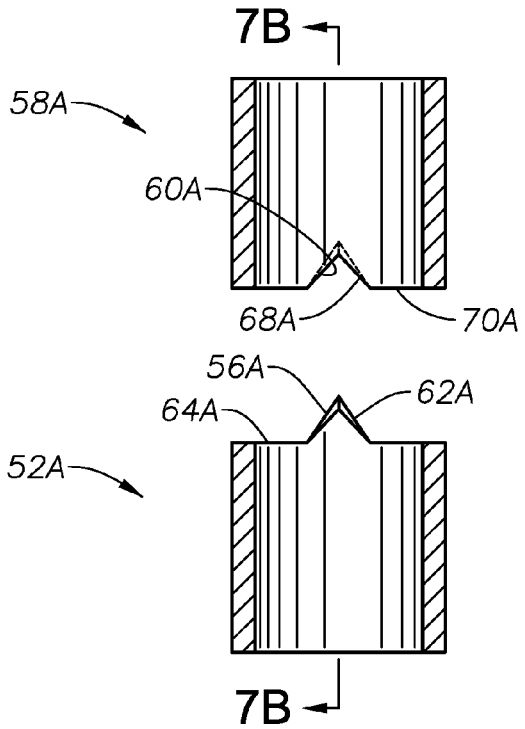
FIGS. 7A and 7B are side sectional views of an alternate embodiment of the bushings of FIGS. 4A and 5A.
Figure 7B:
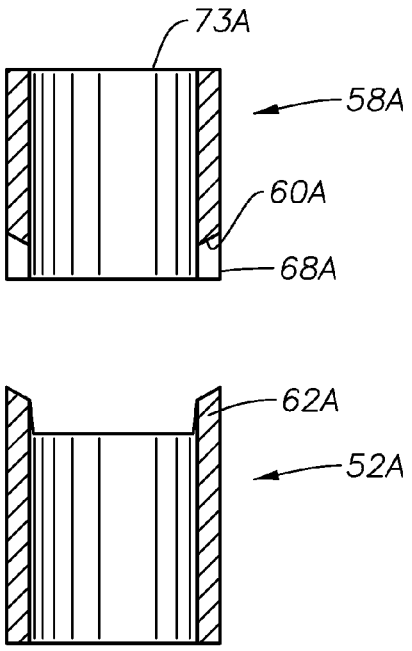

FIGS. 7A and 7B are side sectional views of alternate embodiments of a driver collar 52A and sleeve 58A. In the example embodiment of FIGS. 7A and 7B, the driver collar 52A includes a tooth 56A projecting from an upper end 64A and having a bevel on a lateral edge 62A. Unlike the embodiment of FIG. 6, the bevel on lateral edge 62A angles inward towards the middle portion of the tooth 56A with travel from the outer surface of the driver collar 52A. In the example embodiments of FIGS. 7A and 7B, the inwardly projecting lateral edges 62A angle inward in the direction from outer surface of the driver collar 52A towards an inner surface of the driver collar 52A. Similarly, the sleeve 58A of FIGS. 7A and 7B includes a recess 60A on its lower end 70A with beveled lateral edges 68A that, as shown by the dashed line, angle outward away from one another in a direction from the inner surface of the sleeve 58A towards the outer surface of the sleeve 58A. Referring to FIG. 7B, the angle of the beveling of the lateral edges 62A, 68A can be seen wherein the line of the interface projects away from an upper end 73A of the sleeve 58A with distance from the outer surfaces of the sleeve 58A and driver collar 52A. Alternate embodiments exist, wherein different teeth and/or recesses provided respectively on the driver collar 52, 52A and sleeve 58, 58A may alternate in the direction of projection from the outer to inner surfaces of these annular members. In one example, malleable materials are used to form the drive collar 52 and more brittle materials make up the sleeve 58, the difference in the plasticity between the materials can allow the more malleable member to act like a wedge and build tensile stresses in locations such as the corner 72. To alleviate the concentration of tensile stress the driving surface can be cut at a constant angle to the shaft axis rather than a perpendicular ray, as shown in FIGS. 7A and 7B. The angle can be such that the malleable surface will be angled radially outward and at the interface so that, along with the compressive force a the face from the torque and thrust, it will develop a radially inward compression force as the malleable drive collar 52 inward on the sleeve 58.

Figure 8:
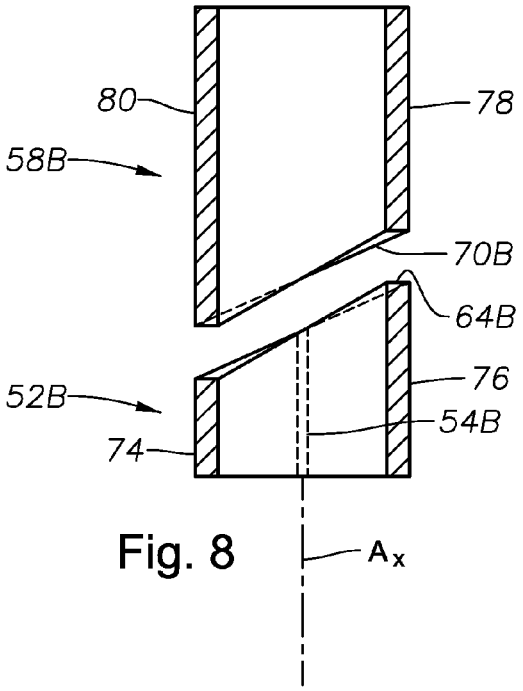
FIG. 8 is a side sectional view of an alternate embodiment of a drive bushing and a driven bushing.

In FIG. 8, alternate embodiments of a driver collar 52B and sleeve 58B are illustrated in a side sectional view. In this example, the terminal ends of the driver collar 52B and sleeve 58B that engage one another are angled so that when in contact they form an interface that runs generally oblique to an axis $A_X$ of the driving collar 52B and sleeve 58B. The angled profile shown in FIG. 8 produces opposing ends wherein approximately one half of the circumference of each end protrudes past the other half. For example, when viewed from the sleeve 58 and along the axis $A_X$, if end of the driver collar 52B is bisected with a line (not shown) that projects perpendicular to the figure, the length of projection increases with distance away from the bisecting line. In contrast, the shorter side is truncated with distance away from the bisecting line. This in turn defines a heel side 74, i.e., a shorter side of the engaging end of the driver collar 52B, and a toe side 76 defined along the axially longer side of the engaging end of the driver collar 52B. Similarly, a heel side 78 and a toe side 80 is provided on the sleeve 58B, wherein the heel side 74 is substantially aligned with the toe side 80 and the toe side 76 is aligned with the heel side 78. As such, when the driver collar 52B and the sleeve 58B are brought into axial contact, an interface is formed between the driver collar 52B and sleeve 58B that runs oblique to the axis $A_X$.

In the embodiment of FIG. 8, the drive collar 52B is cut in the shape of a helical spiral and can allow axial and radial displacement between the drive collar 52B and sleeve 58B and still maintain a surface to surface contact. This helical shape can maintain surface to surface contact for torque and thrust transmission to the sleeve 58B even with radial/axial displacement. In an example, the helix of FIG. 8 can have a pitch in excess of about 30°. In an embodiment, the respective contacting surfaces of the sleeve 58B and drive collar 52B follow a spiral helix path progressing "up" (along the shaft in the axial direction for 180° of rotation), then proceed back "down" the shaft to complete a full rotation at the point where it began. In one example, the contacting surface is coplanar with a radial rays perpendicular to the axis of the sleeve 58B and drive collar 52B. In an embodiment, an axial length is comparable to half the diameter of the sleeve 58B. Alternatively, the aforementioned contact surface can be set on one or more "teeth" projecting from the end of the sleeve/driver and aligning with matching slots in its mating part (FIG. 4A).

Optionally, the upper end 64B of the driver collar 52B may be profiled so that it is oriented at an angle with the axis $A_X$, wherein the angle can vary with respect to the angular location on the driver collar 52B around the axis $A_X$. A similar beveling is shown on the lower end 70B of the sleeve 58B that corresponds with the beveling on the upper end 64B of the driving collar 52B. Beveling the ends 64B, 70B increases the area of contact between the driver collar 52B and sleeve 58B over that of ends that are not beveled. A keyway 54B is shown on an inner surface of the driver collar 52B.

Figure 9:
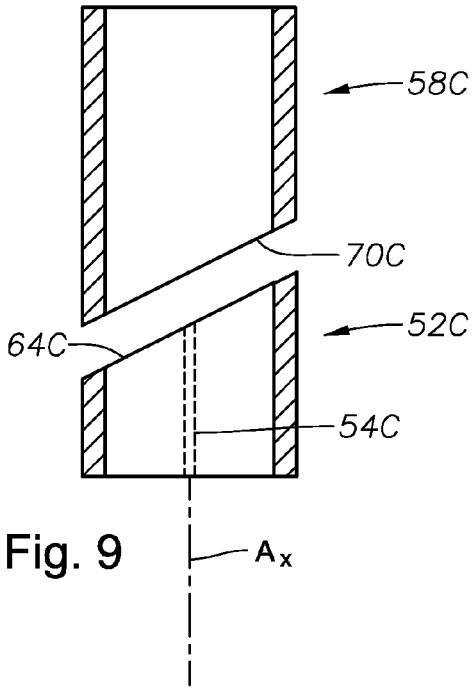
FIG. 9 is a side sectional view of an alternate embodiment of a drive bushing and a driven bushing.

FIG. 9 depicts in side sectional view an alternate embodiment of a sleeve coupling where a driver collar 52C and sleeve 58C are shown with opposing upper and lower ends 64C, 70C that are angled similar to the upper and lower ends 64B, 70B of FIG. 8. The upper and lower ends 64C, 70C run generally perpendicular between the respective inner and outer surfaces of the driver collar 52B and sleeve 58B thereby lacking the beveling of FIG. 8. Thus, the upper and lower ends 64C, 70C remain substantially within a plane intersecting the axis $A_X$ at an oblique angle.

Figure 1:
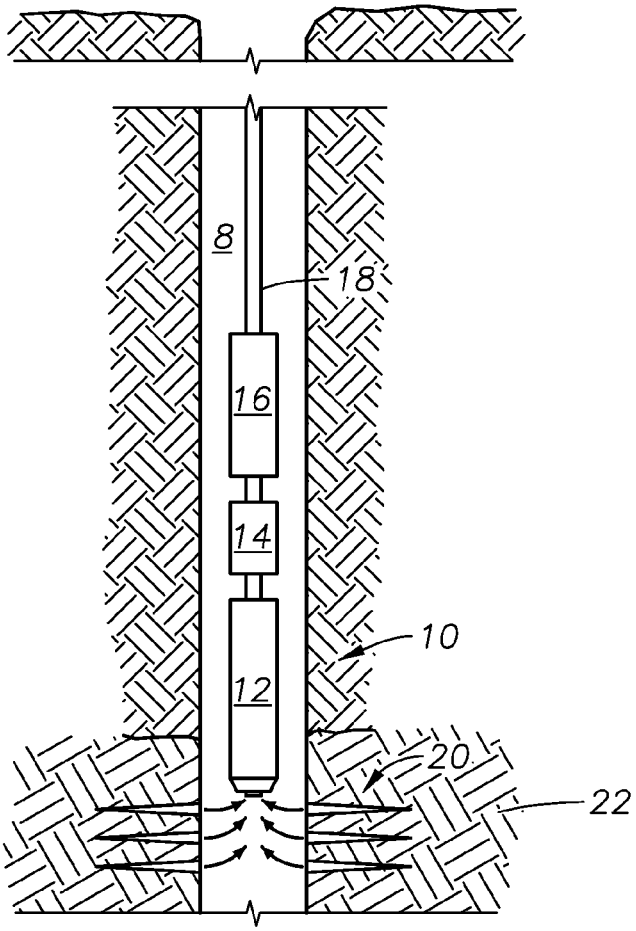
Fig. 1 (Prior Art)
FIG. 1 is a side partial sectional view of a prior art submersible pumping system disposed in a wellbore.
Figure 2:
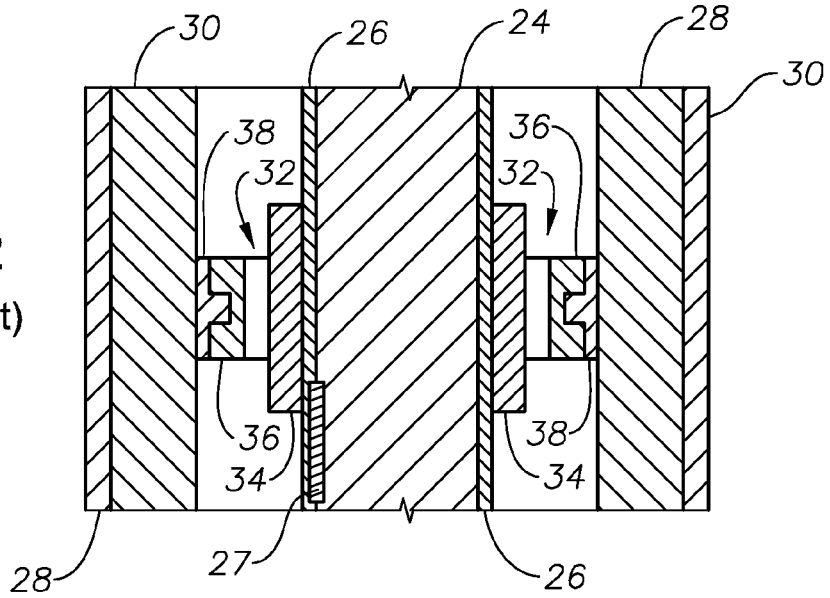
Fig. 2 (Prior Art)
FIGS. 2 and 3 are a side sectional views of prior art bearing systems for use in a submersible pumping system.
Figure 3:
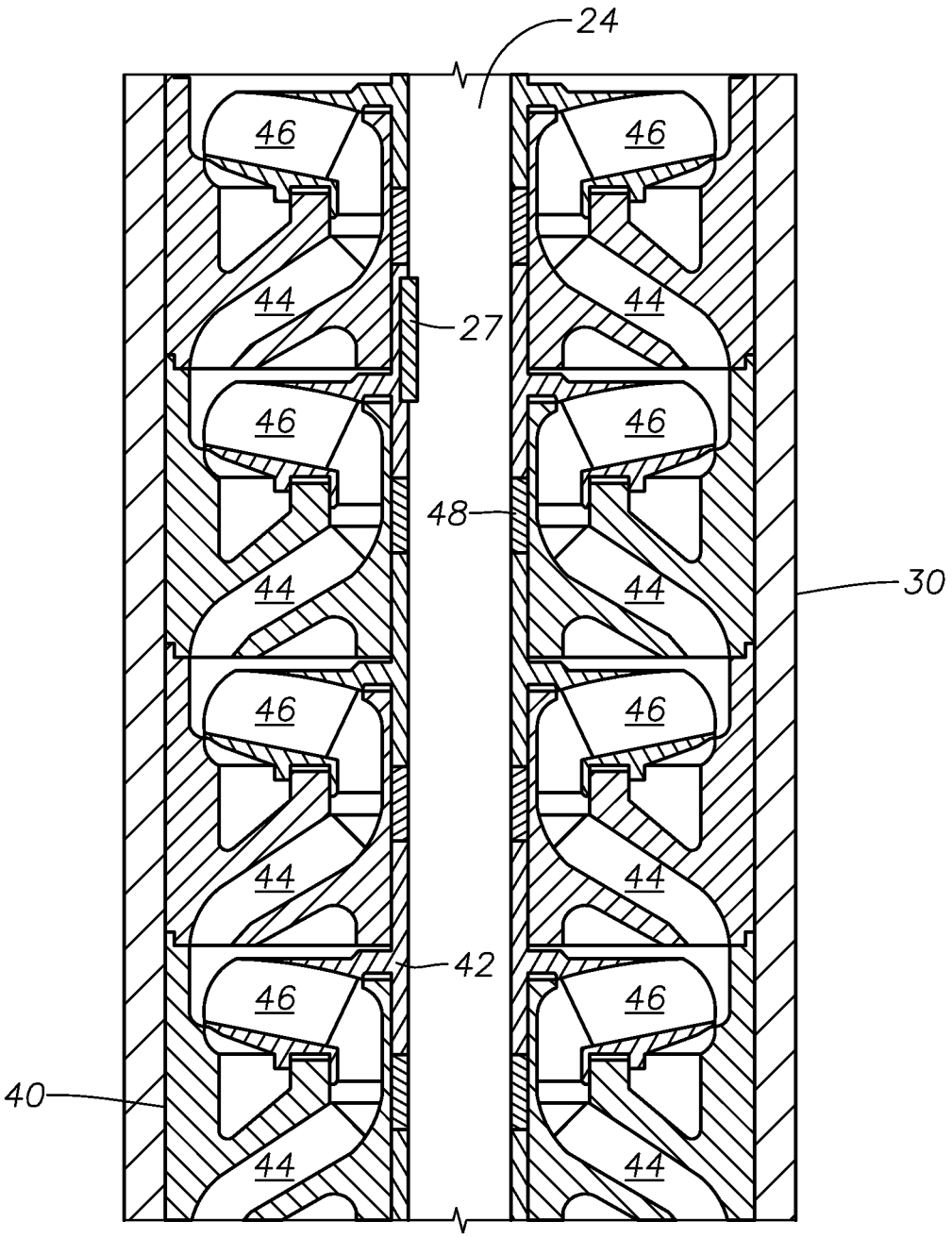
Fig. 3 (Prior Art)
Figure 10:
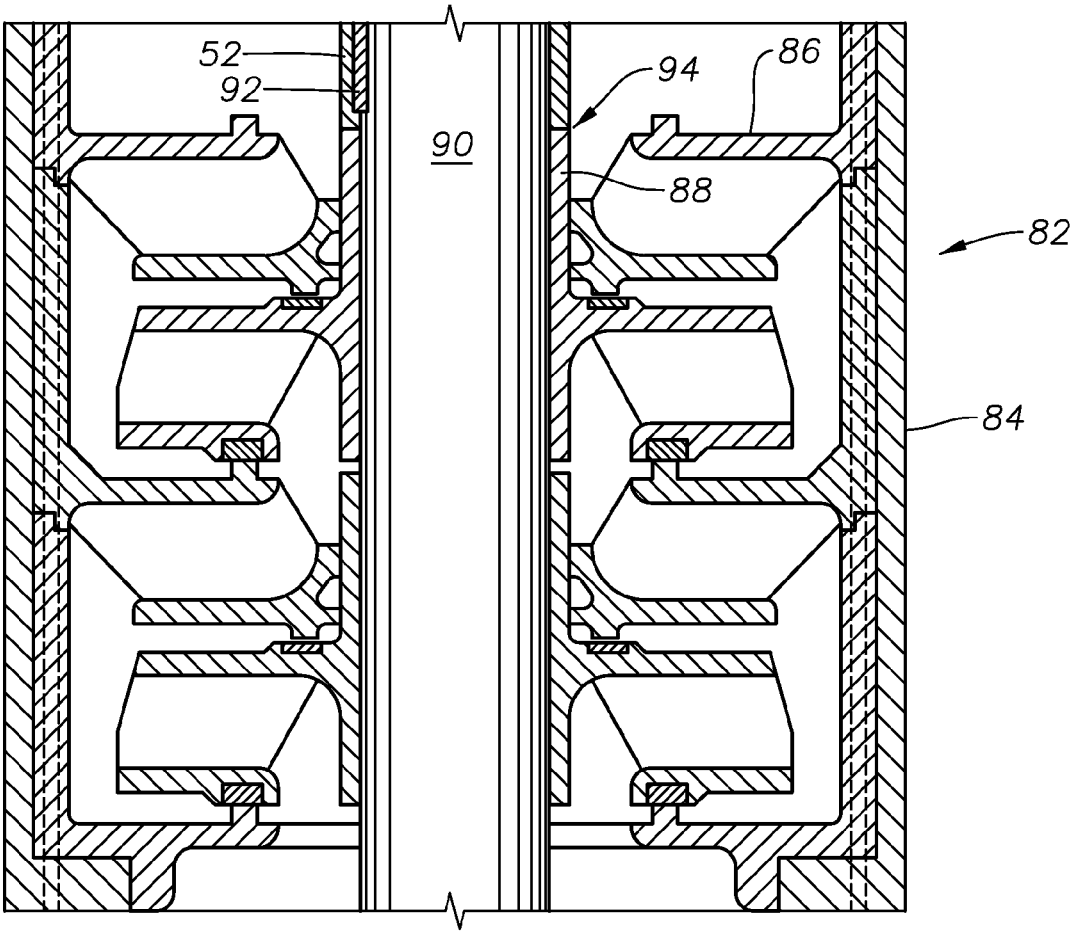
FIG. 10 is an example embodiment of a pumping system having the drive and driven bushings in accordance with the present disclosure.

FIG. 10, a side sectional view of an electrical submersible pump assembly 82 is illustrated. In this example embodiment, the pump assembly 82 includes a body 84 on its outer circumference for housing a stack of diffusers 86 set within the housing with impellers 88 alternatingly set between the diffusers 86. The impellers 88 are coupled to and driven by a shaft 90, so that when rotated, the impellers 88 pressurize and move fluid through the pump assembly 82. A key 92 is shown mounting an example embodiment of a driver collar 52 onto the shaft 90. The driver collar 52 axially couples with a hub portion of the impeller 88 in one of the embodiments of FIGS. 4A through 9, so that as the driver collar 52 is rotated by rotation of the shaft 90, the impeller 88 also is rotated. An example interface 94 is illustrated along a line of contact between the driver collar 52 and impeller 88. Optionally, the coupling configurations described above may be employed in the assembly of FIG. 2 so that a sleeve 26 may be indirectly driven by the shaft 90, thus when torque on the shaft causes the shaft to angularly displace along its axial length, the angular displacement is absorbed by the more elastic driver collar 52 and not by the more brittle sleeve, impeller base, or bushing. As the shaft 90 twists, the drive collar 52 may rotate slightly relative to the sleeve 26. This causes the sleeve 26 to move axially slightly relative to the drive collar 52.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation.

The invention claimed is:

1. An electrical submersible pump (ESP) comprising:

a motor;

a pump having first and second diffusers, and an impeller located between the first and second diffusers;

a rotatable shaft extending from the motor into the pump and having a longitudinal axis;

an annular drive collar mounted around a portion of the shaft for rotation with the shaft;

the impeller having an annular sleeve circumscribing the shaft and having an end in engagement with an end of the drive collar along an interface, the ends being in planes perpendicular to the axis, the sleeve and the drive collar being axially moveable on the shaft relative to each other between a first position in abutment with each other and a second position spaced apart from each other, the interface having a profile so that rotation of the drive collar with the shaft imparts rotation to the sleeve; wherein the profile comprises:

a triangular-shaped protrusion extending axially from one of the ends, the protrusion having two straight edges inclining from said one of the ends toward each other relative to the axis and joining at an apex;

a V-shaped recess in the other of the ends that has a mating configuration to and receives the protrusion, wherein dimensions of the protrusion and the recess are selected such that the protrusion is fully located in the recess while in the first position and partially received in the recess while in the second position, so that an area of driving contact is maintained between the protrusion and the recess while the impeller is in the first position and in the second position; and an increment of circumferential rotation of the drive collar relative to the sleeve occurs while the impeller moves between the first position and the second position.

2. The ESP of claim 1, wherein:

axial lengths of the protrusion and the recess are greater than a distance between the ends of the impeller and the drive collar while in the second position.

3. The ESP of claim 1, wherein the protrusion is located on the end of the drive collar and is rigid relative to the drive collar so as to be immovable relative to the drive collar in response torque being transmitted from the protrusion to the sleeve.

4. The ESP of claim 1, wherein:

the drive collar and the sleeve each has an inner diameter surface and an outer diameter surface;

the recess has two straight edges that incline toward each other relative to the axis and join at a valley; and the straight edges of the protrusion and the recess are beveled at a single inclination from the outer diameter surface to the inner diameter surface, such that at any selected point along the straight edges of the protrusion and the recess, a line extending along the selected point from the outer diameter surface to the inner diameter surface and through the axis would be in a plane oblique to the axis, thereby increasing the area of contact between the straight edges of the protrusion and the straight edges of the sleeve.

5. The ESP of claim 1, further comprising:

a key between the drive collar and the shaft for causing the drive collar to rotate with the shaft; and wherein the sleeve comprises a hub of the impeller.

6. The ESP of claim 1, wherein the material of the drive collar is more elastic than the material of the sleeve.

7. A submersible pump assembly comprising:

a motor;

a pump having an impeller located between first and second diffusers;

a drive shaft driven by the motor and extending along an axis into the pump;

an annular drive collar mounted on the shaft to rotate with the shaft and being axially slideable along the shaft, the drive collar having a cylindrical inner diameter surface and a cylindrical outer diameter surface;

a triangular shaped tooth axially protruding from a portion of an end of the drive collar with two straight inclined edges that incline toward each other and intersect at an apex of the tooth;

the inclined edges of the tooth being beveled such that at any point along the inclined edges of the tooth, the inclined edges of the tooth slant selectively downward or upward along a continuous sloped surface extending from the inner diameter surface to the outer diameter surface relative to the axis, the continuous sloped surface being free of any structure protruding therefrom;

the impeller having annular sleeve carried on the shaft and having an end with a V-shaped recess with straight inclined edges that correspond to the inclined edges of the tooth on the end of the drive collar, so that when the ends of the drive collar and sleeve are abutted, the tooth enters the recess to impart rotation of the drive collar to the sleeve; wherein an axial length of the sleeve is less than an axial distance between the first and second diffusers by a selected amount, the impeller being axially movable on the shaft a distance equal to the selected amount;

the collar and the sleeve are free to move axially by the selected amount on the shaft relative to each other;

dimensions of the tooth and the recess are selected such that an area of contact remains between the inclined edges of the tooth and the recess to impart rotation to the drive sleeve while the collar and sleeve have moved apart from each other by the selected amount; and the inclined edges of the tooth and the recess slide along each other to cause the collar and the sleeve to rotate slightly relative to each other while moving axially apart and toward each other.

8. A submersible pump assembly, comprising:

a motor;

a centrifugal pump having an impeller located between first and second diffusers;

a rotatable shaft extending from the motor into the pump and having a longitudinal axis;

an annular drive collar mounted around a portion of the shaft in the pump for rotation with the shaft, the drive collar having an end located in a plane perpendicular to the axis;

the impeller having a hub circumscribing the shaft and having an end that is in a plane perpendicular to the axis and in abutting engagement with the end of the drive collar;

the impeller being axially movable on the shaft by a selected amount between abutment with the first diffuser and abutment with the second diffuser;

a triangular-shaped protrusion extending axially from one of the ends, the protrusion having two straight inclined edges inclining from said one of the ends toward each other relative to the axis and joining at an apex;

a triangular-shaped recess in the other of the ends that has two straight inclined edges inclined from the other of the ends toward each other relative to the axis and joining at a valley; wherein the drive collar and the hub are axially movable relative to each other by the selected amount between an abutting position, wherein the ends of the drive collar and the hub abut each other, and an axially spaced apart position when the ends are axially spaced apart from each other, the selected amount being less than an axial dimension of the protrusion from the end of the drive collar to the apex such that an area of driving contact is maintained between the protrusion and the recess while in the spaced apart position; and while moving between the abutting position and the axially spaced apart position, the inclined edges of the tooth and the recess slide against each other and the drive collar and the hub rotate relative to each other.

* * * * *